US007908230B2

(12) United States Patent
Bailey et al.

(10) Patent No.: US 7,908,230 B2
(45) Date of Patent: Mar. 15, 2011

(54) SYSTEM, METHOD, AND APPARATUS FOR FRACTURE DESIGN OPTIMIZATION

(75) Inventors: William John Bailey, Somerville, MA (US); Joseph Ayoub, Katy, TX (US); Benoit Couet, Belmont, MA (US); Vincent Dury, Oslo (NO); Wenyu Kong, Cheltenham (GB); David J Wilkinson, Ridgefield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 705 days.

(21) Appl. No.: 12/026,589

(22) Filed: Feb. 6, 2008

(65) Prior Publication Data

US 2008/0209997 A1 Sep. 4, 2008

Related U.S. Application Data

(60) Provisional application No. 60/890,244, filed on Feb. 16, 2007.

(51) Int. Cl.
*G06N 5/00* (2006.01)

(52) U.S. Cl. ..... 706/13; 706/45

(58) Field of Classification Search ..... 706/13, 706/45

See application file for complete search history.

(56) References Cited

U.S. PATENT DOCUMENTS

| | | | |
|---|---|---|---|
| 6,196,318 | B1 | 3/2001 | Gong et al. |
| 6,776,235 | B1 | 8/2004 | England |
| 6,847,034 | B2 | 1/2005 | Shah et al. |
| 6,876,959 | B1 | 4/2005 | Peirce et al. |
| 6,978,832 | B2 | 12/2005 | Gardner et al. |
| 6,993,432 | B2 | 1/2006 | Jenkins et al. |
| 7,013,976 | B2 | 3/2006 | Nguyen et al. |
| 7,017,665 | B2 | 3/2006 | Nguyen |
| 7,021,379 | B2 | 4/2006 | Nguyen |
| 7,028,774 | B2 | 4/2006 | Nguyen et al. |
| 7,032,667 | B2 | 4/2006 | Nguyen et al. |
| 7,059,406 | B2 | 6/2006 | Nguyen et al. |
| 7,063,150 | B2 | 6/2006 | Slabaugh et al. |
| 7,063,151 | B2 | 6/2006 | Nguyen et al. |

(Continued)

FOREIGN PATENT DOCUMENTS

WO 2004009956 1/2004

OTHER PUBLICATIONS

Castle, et al., Fracture Dissolution of Carbonate Rock: An Innovative Process for Gas Storage, Topical Report, Department of Geological Sciences, Clemson University, Clemson, SC, May 2, 2005, pp. 1-131.*

(Continued)

*Primary Examiner* — Wilbert L Starks, Jr.

(74) *Attorney, Agent, or Firm* — David Cate; Robin Nava; Jeffrey Griffin

(57) ABSTRACT

A method for optimizing fracture treatments includes interpreting a nominal pump schedule corresponding to a nominal value for each fracture control parameter. The method further includes interpreting environmental variables, and interpreting probability distributions for each of the environmental variables that is uncertain. The method further includes defining an objective function such as a net present value of each fracture treatment over a 365 day period following the fracture treatment. The method includes determining an optimal value for each fracture control parameter according to the objective function by determining the fracture control parameter values that yield the best mean net present value given the variability in the environmental variables as described by their probability distributions.

35 Claims, 11 Drawing Sheets

U.S. PATENT DOCUMENTS

| | | | |
|---|---|---|---|
| 7,066,258 | B2 | 6/2006 | Justus et al. |
| 7,073,581 | B2 | 7/2006 | Nguyen et al. |
| 7,082,993 | B2 | 8/2006 | Ayoub et al. |
| 7,111,681 | B2 | 9/2006 | Detournay et al. |
| 7,114,560 | B2 | 10/2006 | Nguyen et al. |
| 7,114,570 | B2 | 10/2006 | Nguyen et al. |
| 7,131,493 | B2 | 11/2006 | Eoff et al. |
| 7,134,492 | B2 | 11/2006 | Willberg et al. |
| 7,156,194 | B2 | 1/2007 | Nguyen |
| 7,216,711 | B2 | 5/2007 | Nguyen et al. |
| 7,237,609 | B2 | 7/2007 | Nguyen |
| 7,451,812 | B2 | 11/2008 | Cooper et al. |
| 2003/0205376 | A1 | 11/2003 | Ayoub et al. |
| 2003/0225521 | A1 | 12/2003 | Panga et al. |
| 2007/0029085 | A1 | 2/2007 | Panga et al. |

OTHER PUBLICATIONS

SPE 20623—Paccaloni, G. and Tambini, M.—Advances in Matrix Stimulation Technology. Mar. 1993-J. Petrol. Tech, ,Society of Petroleum Engineers. 256-263.

SPE 26578—Wang, Y., Hill, A.D., and Schechter, R.S.—The Optimum Injection Rate for Matrix Acidizing of Carbonate Formations. 1993 Society of Petroleum Engineers. 675-687.

SPE 37312—Huang, T., Hill, A.D., and Schechter, R.S.—Reaction Rate and Fluid Loss: The Keys to Wormhole Initiation and Propagatioin in Carbonate Acidizing. 1997 Society of Petroleum Engineers. 775-784.

SPE 54723—Huang, T., Zhu, D., and Hill A.D.—Prediction of Wormhole Population Density in Carbonate Matrix Acidizing. 1999, Society of Petroleum Engineers.

SPE 59537—Fredd, C.N.—Dynamic Model of Wormhole Formation Demonstrates Conditions for Effective Skin Reduction During Carbonate Matrix Acidizing. 2000, Society of Petroleum Engineers.

SPE 65068—Buijse, M.A.—Understanding Wormholing Mechanisms Can Improve Acid Treatments in Carbonate Formations. SPE Prod. & Facilities 15 (3), Aug. 200. Society of Petroleum Engineers. 168-175.

SPE 66566—Bazin, B.—From Matrix Acidizing to Acid Fracturing: A Laboratory Evaluation of Acid/Rock Interactions. Feb. 2001 SPE Production & Facilities. 22-29. 2001 Society of Petroleum Engineers.

SPE 71511—Pomes, V., Bazin, B., Golfier, F., Zarcone, C., Lenormand, R., and Quintard, M.—On the Use of Upscaling Methods to Describe Acid Injection in Carbonates. 2001 Society of Petroleum Engineers, Inc. 1-11.

SPE 86568—Raghuraman, B., Couet, B., Savundararaj, P., Bailey, W.J. and Wilkinson, D.J.—Valuation of Technology and Information for Reservoir Risk Management. Oct. 2003 SPE Reservoir Evaluation & Engineering. 307-315. 2003 Society of Petroleum Engineers.

SPE 87026—Bailey, W.J., Couet, B., and Wilkinson, D.—Framework for Field Optimization to Maximize Asset Value. Feb. 2005 SPE Reservoir Evaluation & Engineering. 7-21. 2005 Society of Petroleum Engineers.

Balakotaiah, V., and West, D.H.—Shape Normalization and Analysis of the Mass Transfer Controlled Regime in Catalytic Monoliths. Chemical Engineering Science 57 (2002) 1269-1286. Elseiver Science Ltd.

Civan, F.—Scale Effect on Porosity and Permeability: Kinetics, Model, and Correlation. AIChE Journal, Feb. 2001, vol. 47. No. 2. 271-287.

Fredd, C.N. and Fogler, H.S.—Influence of Transport and Reaction on Wormhole Formation in Porous Media. AIChE Journal—Fluid Mechanics and Transport Phenomena, Sep. 1998 vol. 44, No. 9. 1933-1949.

Golfier, F., Zarcone, C., Bazin, B., Lenormand, R., Lasseaux, D. and Quintard, M.—On the Ability of a Darcy-scale Model to Capture Wormhole Formation During the Dissolution of a Porous Medium. J. Fluid Mech (2002), vol. 457, pp. 213-254. 2002 Cambridge University Press.

Gupta, N. and Balakotaiah, V.—Heat and Mass Transfer Coefficients in Catalytic Monoliths. Chemical Engineering Science 56 (2001) 4771-4786. Elsevier Science Ltd.

Hoefner, M.L., Fogler, H.S.—Pore Evolutioin and Channel Formation During Flow and Reaction in Porous Media. AIChE Journal, Jan. 1988, vol. 34, No. 1. pp. 45-54.

* cited by examiner

300

204

209/310

Multipliers

| 312 Stage Name | 302 Pump Rate bbl/min | | Fluid Name | 308 Gel Conc lb/mgal | 306 Fluid Volume gal | | 304 Prop Conc PPA | | Prop Mass lb |
|---|---|---|---|---|---|---|---|---|---|
| PAD | 20 | A | 30lbGel+1lbsJ475/Mgal | 30 | 21,000 | C1 | 0.0 | 1 | 0 |
| 1 PPA | 20 | A | 30lbGel+1lbsJ475/Mgal | 30 | 1,000 | C2 | 1.0 | B | 1,000 |
| 2 PPA | 20 | A | 30lbGel+1lbsJ475/Mgal | 30 | 1,000 | C3 | 2.0 | B | 2,000 |
| 3 PPA | 20 | A | 30lbGel+1lbsJ475/Mgal | 30 | 1,000 | C4 | 3.0 | B | 3,000 |
| 4 PPA | 20 | A | 30lbGel+1lbsJ475/Mgal | 30 | 1,000 | C5 | 4.0 | B | 4,000 |
| 5 PPA | 20 | A | 30lbGel+1lbsJ475/Mgal | 30 | 1,000 | C6 | 5.0 | B | 5,000 |
| 6 PPA | 20 | A | 30lbGel+1lbsJ475/Mgal | 30 | 5,000 | C7 | 6.0 | B | 30,000 |
| 7 PPA | 20 | A | 30lbGel+1lbsJ475/Mgal | 30 | 7,000 | C8 | 7.0 | B | 49,000 |
| 8 PPA | 20 | A | 30lbGel+1lbsJ475/Mgal | 30 | 11,000 | C9 | 8.0 | B | 88,000 |
| FLUSH | 20 | 1 | WF130 | 30 | 5,443 | | 0.0 | 1 | 0.0 |
| TOTALS | | | | | 54,443 | | | | 182,000 |

Fig. 3

400

205

402

404

401

410

412

| Variable which will be affected | Symbol | Units | VALUE [physical] | Lower bound | Upper bound |
|---|---|---|---|---|---|
| Pump Rate | q | bbl/min | 20.00 | 10.00 | 30.00 |
| Total proppant mass | Wp | lb | 182,000 | 125,000 | 250,000 |
| Max proppant conc | Cf | lb/gal | 8.00 | 4.00 | 12.00 |
| Total injected volume | Vi | bbl | 1,493 | 1,200 | 2,000 |

406

408

Fig. 4

500 206 502 510 506 508

| Description | Unit | Symbol(+unit) | Expression |
|---|---|---|---|
| Average proppant concentration | PPA | $\overline{Cp}$ | Wp / Vi |
| Volume of fracture at end of pumping | bbl | V*f* | Wp / Cf |
| Efficiency of (PAD) | - | η | $\frac{\overline{Cp}}{Cf}$ |
| Exponent | - | $\varepsilon$ | $\frac{1-\eta}{1+\eta}$ |
| Pad volume | bbl | V*pad* | Vi x $\varepsilon$ |
| Time to pump PAD | min | T*pad* | Vpad / q |
| Total injection time | min | T*inj* | Vi / q |
| Proppant concentration time function | PPA (t) | *Cp*(*t*) | $Cf\left(\frac{t-Tpad}{Tinj-Tpad}\right)^{\varepsilon}$ |

| | | | | | |
|---|---|---|---|---|---|
| Average Propp | Cp_bar | lb/bbl | 2.9024 | = Wp / Vi | 510 |
| Efficiency | eta | | 36.2805% | = Cp_bar / Cf | |
| epsilon | epsilon | | 46.7561% | =(1-eta)/(1+eta) | |
| Pad Volume | Vpad | bbl | 698.07 | = Vi / q | 506 |
| Time (injection) | ti | min | 74.65 | = Vi / q | |
| Time (pad) | Tpad | min | 34.90 | = Vpad / q | |

Fig. 5A 500 512 204 514 514 514

| Computed schedule | time | cp(t) | Prop conc | Volume | Stage slurry volume | | | |
|---|---|---|---|---|---|---|---|---|
| | | | | | 702.0 | 23.8 | 47.7 | .... |
| Index | | | | | 0 | 1 | 2 | .... |
| tpad | 34.9 | 0.000 | 0.000 | 698.1 | 698.1 | | | |
| 1 | 35.1 | 0.672 | 0.000 | 4.0 | 4.0 | | | |
| 2 | 35.3 | 0.929 | 1.000 | 4.0 | | 4.0 | | |
| 3 | 35.5 | 1.123 | 1.000 | 4.0 | | 4.0 | | |
| 4 | 35.7 | 1.284 | 1.000 | 4.0 | | 4.0 | | |
| 5 | 35.9 | 1.426 | 1.000 | 4.0 | | 4.0 | | |
| 6 | 36.1 | 1.553 | 1.000 | 4.0 | | 4.0 | | |
| 7 | 36.3 | 1.669 | 1.000 | 4.0 | | 4.0 | | |
| 8 | 36.5 | 1.776 | 2.000 | 4.0 | | | 4.0 | |
| 9 | 36.7 | 1.877 | 2.000 | 4.0 | | | 4.0 | |
| 10 | 36.9 | 1.971 | 2.000 | 4.0 | | | 4.0 | |
| 11 | 37.1 | 2.061 | 2.000 | 4.0 | | | 4.0 | |
| 12 | 37.3 | 2.147 | 2.000 | 4.0 | | | 4.0 | |
| 13 | 37.5 | 2.229 | 2.000 | 4.0 | | | 4.0 | |
| 14 | 37.7 | 2.307 | 2.000 | 4.0 | | | 4.0 | |
| 15 | 37.9 | 2.383 | 2.000 | 4.0 | | | 4.0 | |
| 16 | 38.1 | 2.456 | 2.000 | 4.0 | | | 4.0 | |
| 17 | 38.3 | 2.527 | 2.000 | 4.0 | | | 4.0 | |
| 18 | 38.5 | 2.595 | 2.000 | 4.0 | | | 4.0 | |
| 19 | 38.7 | 2.661 | 2.000 | 4.0 | | | 4.0 | |
| .... | .... | .... | .... | .... | | | | |
| .... | .... | .... | .... | .... | | | | |
| n | | | 8.000 | | | | | |
| n+1 | | | 0(Flush) | | | | | |

Fig. 5B 600 602 232 604 606

| Stage Name | Pump Rate bbl/min | Fluid Name | Gel Conc lb/mgal | Fluid Volume gal | Prop Conc PPA | Prop Mass lb | Slurry Volume bbl | Pump Time min |
|---|---|---|---|---|---|---|---|---|
| PAD | 24.0 | PrimeFRAC 30+ | 30 | 23,100 | 0.0 | 0 | 550.0 | 22.92 |
| 1 PPA | 24.0 | PrimeFRAC 30+ | 30 | 1,100 | 1.1 | 1,210.0 | 27.5 | 1.15 |
| 2 PPA | 24.0 | PrimeFRAC 30+ | 30 | 1,100 | 2.2 | 2,420.0 | 28.8 | 1.20 |
| 3 PPA | 24.0 | PrimeFRAC 30+ | 30 | 1,100 | 3.3 | 3,630.0 | 30.1 | 1.25 |
| 4 PPA | 24.0 | PrimeFRAC 30+ | 30 | 1,100 | 4.4 | 4,840.0 | 31.4 | 1.31 |
| 5 PPA | 24.0 | PrimeFRAC 30+ | 30 | 1,100 | 5.5 | 6,050.0 | 32.7 | 1.36 |
| 6 PPA | 24.0 | PrimeFRAC 30+ | 30 | 5,500 | 6.6 | 36,300.0 | 170.1 | 7.09 |
| 7 PPA | 24.0 | PrimeFRAC 30+ | 30 | 7,700 | 7.7 | 59,290.0 | 247.3 | 10.30 |
| 8 PPA | 24.0 | PrimeFRAC 30+ | 30 | 12,100 | 8.8 | 106,480.0 | 402.9 | 16.79 |
| FLUSH | 24.0 | WF130 | 30 | 5,443 | 0.0 | 0.0 | 129.6 | 6.5 |
| TOTALS | | | | 59,343 | | 220,220 | 1,650 | 69.8 |

209 610 608

| Variable which will be affected | CV Number | Value [multiplier] | Lower Bound | Upper Bound |
|---|---|---|---|---|
| Pump rate | 1 | 1.0 | 0.5 | 3.0 |
| Fluid volume | 2 | 1.0 | 0.5 | 3.0 |
| Proppant concentration | 3 | 1.0 | 0.5 | 3.0 |

230C 230B 230A

| Stage Name | Pump rate Affects: PUMP_RATE | | | Fluid volume Affects: FLU_VOL | | | Proppant concentration Affects: PROP_CONC | | |
|---|---|---|---|---|---|---|---|---|---|
| | Orig Value bbl/min | New Value bbl/min | Factor Used | Orig Value gal | New Value gal | Factor Used | Orig Value PPA | New Value PPA | Factor Used |
| PAD | 20 | 24 | 1.2000 | 21,000 | 23,100 | 1.1000 | 0 | 0 | 1.1000 |
| 1 PAD | 20 | 24 | 1.2000 | 1,000 | 1,100 | 1.1000 | 1 | 1 | 1.1000 |
| 2 PAD | 20 | 24 | 1.2000 | 1,000 | 1,100 | 1.1000 | 2 | 2 | 1.1000 |
| 3 PAD | 20 | 24 | 1.2000 | 1,000 | 1,100 | 1.1000 | 3 | 3 | 1.1000 |
| 4 PAD | 20 | 24 | 1.2000 | 1,000 | 1,100 | 1.1000 | 4 | 4 | 1.1000 |
| 5 PAD | 20 | 24 | 1.2000 | 1,000 | 1,100 | 1.1000 | 5 | 6 | 1.1000 |
| 6 PAD | 20 | 24 | 1.2000 | 5,000 | 5,500 | 1.1000 | 6 | 7 | 1.1000 |
| 7 PAD | 20 | 24 | 1.2000 | 7,000 | 7,700 | 1.1000 | 7 | 8 | 1.1000 |
| 8 PAD | 20 | 24 | 1.2000 | 11,000 | 12,100 | 1.1000 | 8 | 9 | 1.1000 |

Fig. 6

700

232

| Stage Name | 230 From Input Pump Rate bbl/min | Fluid Name | Gel Conc lb/mgal | 230 Computed Fluid Volume gal | Prop Conc PPA | 230 Computed Prop Mass lb | From Table Slurry Volume bbl | Computed Pump Time min |
|---|---|---|---|---|---|---|---|---|
| PAD | 20.0 | PrimeFRAC 30+ | 30 | 29,486 | 0.0 | 0 | 702.0 | 35.1 |
| 1 PPA | 20.0 | PrimeFRAC 30+ | 30 | 958 | 1.0 | 958.2 | 23.8 | 1.2 |
| 2 PPA | 20.0 | PrimeFRAC 30+ | 30 | 1,837 | 2.0 | 3,673.6 | 47.7 | 2.4 |
| 3 PPA | 20.0 | PrimeFRAC 30+ | 30 | 2,792 | 3.0 | 8,376.9 | 75.5 | 3.8 |
| 4 PPA | 20.0 | PrimeFRAC 30+ | 30 | 3,674 | 4.0 | 14,697.9 | 103.3 | 5.2 |
| 5 PPA | 20.0 | PrimeFRAC 30+ | 30 | 4,355 | 5.0 | 21,777.0 | 127.2 | 6.4 |
| 6 PPA | 20.0 | PrimeFRAC 30+ | 30 | 5,250 | 6.0 | 31,502.0 | 159.0 | 7.9 |
| 7 PPA | 20.0 | PrimeFRAC 30+ | 30 | 6,084 | 7.0 | 42,585.9 | 190.8 | 9.5 |
| 8 PPA | 20.0 | PrimeFRAC 30+ | 30 | 1,960 | 8.0 | 15,683.8 | 63.6 | 3.2 |
| FLUSH | 20.0 | WF130 | 30 | 5,443 | 0.0 | 0.0 | 129.6 | 6.5 |
| TOTALS | | | | 61,841 | | 139,255 | 1,623 | 81.1 |

Fig. 7

SYSTEM, METHOD, AND APPARATUS FOR FRACTURE DESIGN OPTIMIZATION

CROSS-REFERENCE TO RELATED APPLICATION

The present document is based on and claims priority to U.S. Provisional Application Ser. No. 60/890,244, filed Feb. 16, 2007.

FIELD OF THE INVENTION

The present invention relates to techniques for fracture optimization. More particularly, the present invention relates to fracture optimization where one or more environmental variables are not known with certainty.

BACKGROUND

Fracturing of earth formations is well known in the oilfield and other areas to improve the producibility and/or the injectivity of a well. The treatment of a well with a fracture can be an expensive procedure, with a high variability of results dependent upon the characteristics of the target formation. The control parameters defining the fracture treatment (e.g. including fluids, proppants, or acids utilized, pumping rates, etc.) are largely but not completely controllable. However, many important characteristics of the formation (or the environmental variables), for example the permeability or the in-situ stresses, are not always known with certainty. Therefore, it is important to design the controllable aspects of the fracture treatment accounting for the characteristics of the formation. Presently available optimization routines can find optimized parameters when the environment variables are known, but do not provide confidence that a true optimum is being designed where one or more environment variables are unknown. A method for optimizing fracture treatments that allows for environmental variables of varying certainty is desirable.

SUMMARY

A method for optimizing fracture treatments includes interpreting a nominal pump schedule corresponding to a nominal value for each fracture control parameter. The method further includes interpreting environmental variables, and interpreting probability distributions for each of the environmental variables that is uncertain. The method further includes defining an objective function such as a net present value of each fracture treatment over a 365 day period following the fracture treatment. The method includes determining an optimal value for each fracture control parameter according to the objective function by determining the fracture control parameter values that yield the best mean net present value given the variability in the environmental variables as described by their probability distributions.

BRIEF DESCRIPTION OF THE FIGURES

FIG. 3 is a first illustration of a nominal pump schedule corresponding to a nominal value for each of at least one fracture control parameter.

FIG. 4 is an illustration of user inputs for a nominal pump schedule corresponding to a nominal value for each of at least one fracture control parameter.

FIG. 5A is an illustration of a set of intermediate quantities consistent with the user inputs for a nominal pump schedule.

FIG. 5B is a second illustration of a nominal pump schedule.

FIG. 6 is a first illustration of a modified pump schedule consistent with the first illustration of a nominal pump schedule.

FIG. 7 is a second illustration of a modified pump schedule consistent with the second illustration of a nominal pump schedule.

DESCRIPTION OF THE ILLUSTRATIVE EMBODIMENTS

Figure 1:
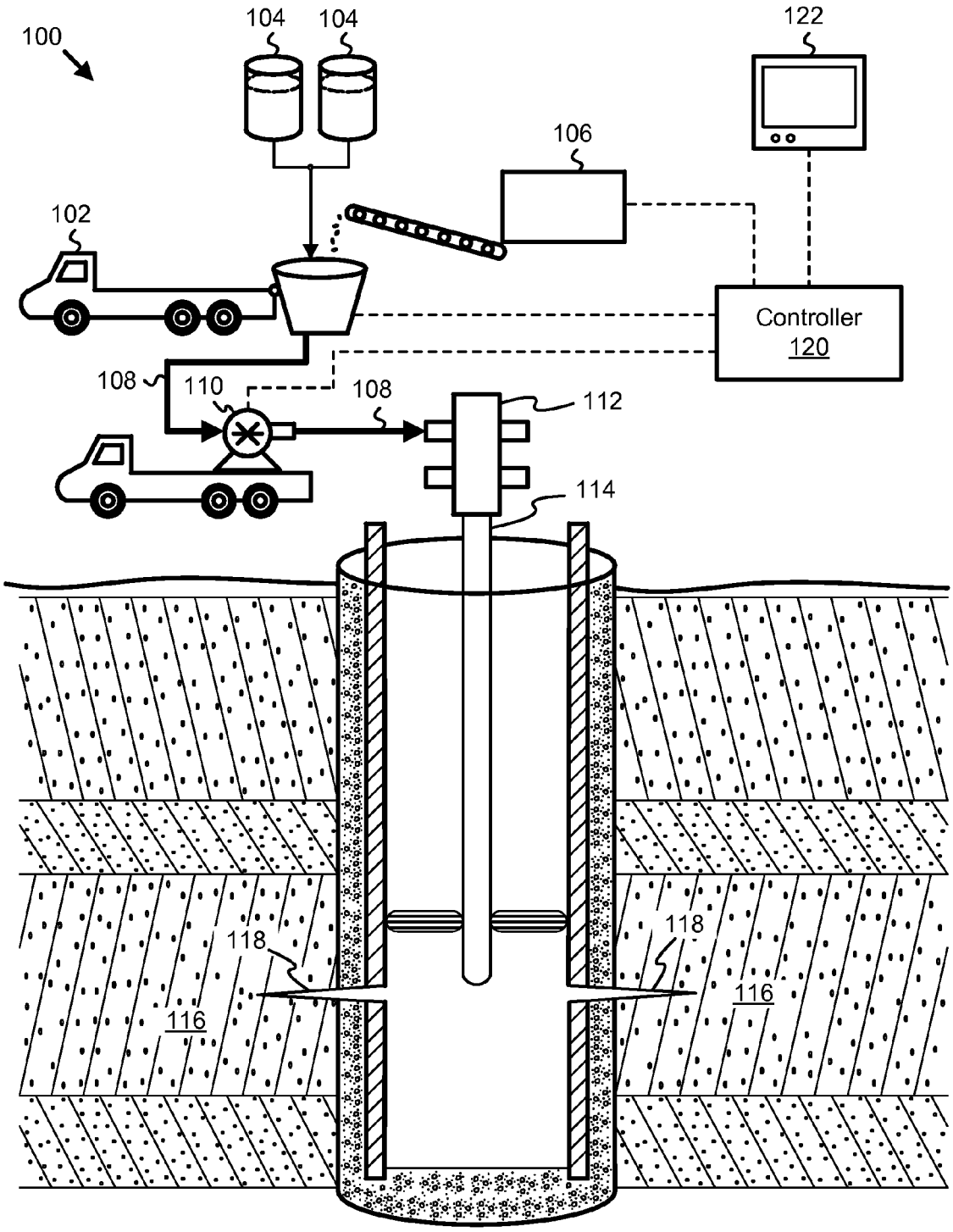
FIG. 1 is a schematic block diagram of a system for optimizing a fracture treatment.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated embodiments, and that such further applications of the principles of the invention as illustrated therein as would normally occur to one skilled in the art to which the invention relates are contemplated and protected.

Certain functional units described herein have been labeled as modules to more particularly emphasize their implementation independence. Modules may be implemented as instructions or logic executable by a processor and stored on a computer readable medium. For example, a module may be implemented as a hardware circuit comprising transistors, logic chips, or other discrete components configured to execute the operations of the module. In certain embodiments, a module may be implemented as instructions on a programmable hardware device. An identified module may comprise one or more physical or logical blocks of computer instructions that may reside together or in disparate locations, which, when joined logically together comprise the module and achieve the stated purpose.

FIG. 1 is a schematic block diagram of a system 100 for optimizing a fracture treatment. The system 100 includes a fluid mixer 102 that utilizes fluid from storage tanks 104. The fluid mixer 102 may mix additives such as stabilizers, breakers, cross-linkers and the like to the fluid. The fluid mixer 102 may further add proppant, for example sand of a specified size distribution, from a sand delivery device 106, to the fluid. The fluid leaves the fluid mixer as a fracturing fluid 108 and is provided to a pump 110. The pump 110 injects the fluid into a wellhead 112, where it passes through a tubing string 114 and into a reservoir layer 116 through a set of perforations 118.

The fluid mixing and pumping devices of the system 100 shown in FIG. 1 are exemplary to certain embodiments, and the devices utilized to perform fluid mixing and pumping vary considerably. Without limitation, all fracturing treatments and devices, including acid fracturing, hydraulic fracturing, fracturing through casing, and fracturing through coiled tubing are contemplated within the present application.

The system 100 further includes a controller 120. The controller 120 of the system 100 performs optimization and communicates a modified pump schedule to the fluid mixing and pumping devices. The controller 120 may be within a fracture control vehicle (not shown), for example a truck with a computer in back in communication with the various mixing and pumping devices and with various sensors distributed around the system 100. The controller 120 may be distributed in locations away from the wellhead 112. For example, and without limitation, the controller 120 may include a computer in a sales office (not shown) that performs an optimization and determines a modified pump schedule. The modified pump schedule may then be communicated to the wellhead 112 location, where the fluid mixing and pumping devices perform a fracture treatment according to the modified pump schedule.

The controller 120 includes modules that functionally execute the operations of optimizing a fracture treatment. The controller 120 includes a nominal pump schedule module, an environment description module, an objective selection module, a fracture optimization module, and a fracture planning module. The specific operations of exemplary embodiments of the controller 120 are described in detail in the section referencing FIG. 2.

In certain embodiments, the system 100 further includes a display device 122 such as a computer monitor, computer printout, monitoring tool capable of reading parameters from a computer memory, or other device capable of displaying information. The display device 122 shows a first simulated fracture according to a nominal pumping schedule and a second simulated fracture according to a modified pumping schedule. In certain embodiments, the display device may display an objective function result for the nominal pumping schedule and the modified pumping schedule—for example a net present value (NPV) calculation for a fracture treatment according to the nominal pumping schedule and an NPV calculation for a fracture treatment according to the modified pumping schedule. The display device 122 may further display an indicator of a limiting factor that may be affecting the modified pumping schedule. For example, a practitioner may have included a maximum wellhead 112 pressure limitation to the controller 120, and in certain instances the wellhead 112 pressure limitation may prevent the modified pumping schedule from achieving an otherwise optimal pumping rate. A practitioner may utilize such limitation information in making various determinations such as whether an upgrade to mitigate the limitation is an economically recommended action.

Figure 2:
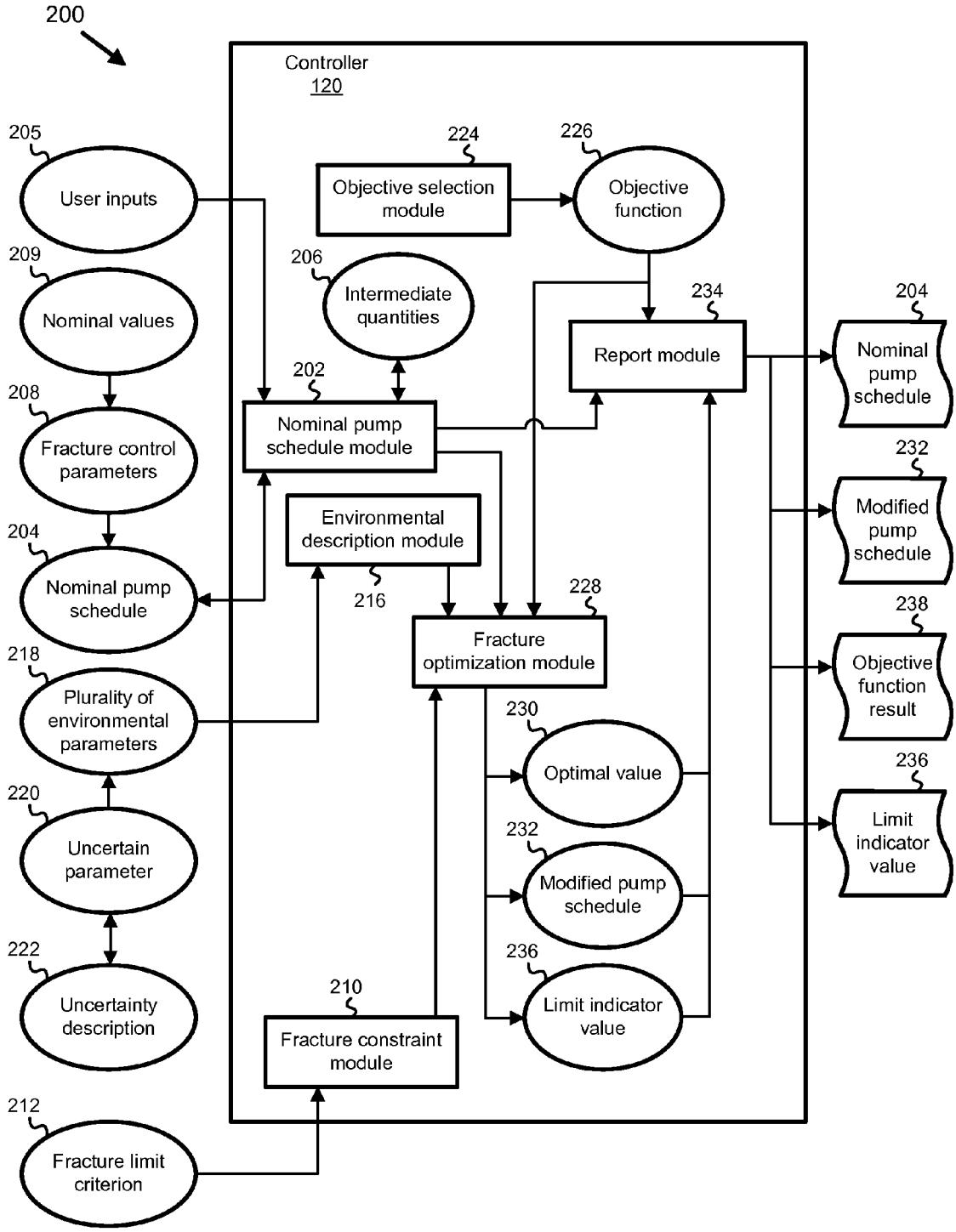
FIG. 2 is a schematic block diagram of a controller for optimizing a fracture treatment.

FIG. 2 is a schematic block diagram of a controller 120 for optimizing a fracture treatment. The controller 120 includes a nominal pump schedule module 202 that interprets a nominal pump schedule 204 corresponding to a nominal value 206 for each of at least one fracture control parameter 208. In certain embodiments, the nominal pump schedule 204 may be a pump schedule input by a user, such as specific stages of a fracture treatment to be performed. For example, the pump schedule may include a pad stage, various proppant stages, and a flush stage. Each stage may include values for the proppant concentrations, pumping rates, fluid type, fluid volume, and similar information that defines a fracture treatment, and various information may be defined for each stage individually and/or for the fracture treatment globally. In certain embodiments, the nominal pump schedule module 202 may interpret the nominal pump schedule 204 by reading values from a computer memory, for example loading a previous fracture treatment schedule designed or performed in a similar geographical location.

In certain embodiments, the nominal pump schedule module 202 may interpret the nominal pump schedule 204 by calculating a pump schedule according to theoretical conventions. For example, a user may provide user inputs 205 such as a pump rate, a total proppant mass, a maximum proppant concentration, and total injected volume. The nominal pump schedule module 202 may then calculate a set of intermediate quantities 206 that are utilized to define the nominal pump schedule 204, and analytically generate a pump schedule that is utilized as the nominal pump schedule 204. The reference "Reservoir Stimulation" by Economides and Nolte in chapter 8 by Meng (Meng), incorporated herein by reference, illustrates analytically generating a nominal pump schedule based on the pump rate, a total proppant mass, a maximum proppant concentration, and total injected volume. More detail of one example of this method is provided in the section referencing FIG. 4.

The nominal pump schedule 204 corresponds to a nominal value 209 for each fracture control parameter 208. For example, the fracture control parameter 208 may be a pumping rate in barrels per minute (bbl/min), and the nominal value 209 for the pumping rate may be a multiplier or a parameter value. In the example, the nominal value 209 for the pumping rate may be 20 bbl/min (i.e. a specific value) or a multiplier. Where the nominal value 209 is a multiplier, the nominal pumping schedule 204 may have a pumping rate (e.g. 20 bbl/min), and the nominal value 209 (typically 1.0 as nominal to avoid confusion, although other values may be utilized) is multiplied by the pumping rate. In the example, if the nominal value 209 is adjusted to 0.5, the pumping rate is cut in half (i.e. 10 bbl/min).

Each fracture control parameter 208 that is available for optimization has a nominal value 209. The nominal value 209 may be a continuous number (e.g. 20 bbl/min), a multiplier, or a discrete selection. For example, the proppant type may be a fracture control parameter 208, and the selections may be limited to discrete choices (e.g. 20/40 sand or 20/40 ceramic proppant). Each stage of the nominal pumping schedule 204 may have individual values for the fracture control parameters 208, or some fracture control parameters 208 may be applied globally to all stages. For example, each stage may be allowed to have an individual fluid volume, but be required to have a common (but variable) pumping rate. Without limitation, available fracture control parameters 208 include the fluid pump rate, fluid volume values, proppant concentration values, the fluid selection (i.e. base fluid type and/or additives), the proppant selection, a gel loading value, and an acid concentration value. Other fracture control parameters 208 are understood in the art and contemplated within the scope of the present application.

In certain embodiments, the controller 120 further includes a fracture constraint module 210 that interprets a fracture limit criterion 212. The fracture limit criterion 212 may be any parameter related to the system 100 that should not be exceeded during a fracture treatment. For example, the fracture limit criterion 212 may include a maximum wellhead 112 pressure, a maximum bottomhole pressure, a minimum pumping stage time, or any other limitation that should be reflected in the pumping schedule. In one embodiment, the fracture limit criterion 212 includes a minimum bottomhole pressure to ensure a reservoir stays above a bubble point pressure. Any number of fracture limit criterion 212 may be available, and the fracture constraint module 210 may interpret the fracture limit criterion 212 by accepting a value from a practitioner, looking up a value in a computer memory location, reading a value from a data communication, and the like. For example and without limitation, the fracture constraint module 210 may interpret a maximum pump rate according to horsepower values published by datalinked pumps 110, the fracture constraint module 210 may interpret a maximum wellhead pressure according to saved information including a tubing burst pressure, and/or the fracture constraint module 210 may accept values from a supervising engineer as fracture limit criterion 212.

The fracture control parameters 208 may be limited to certain data ranges, for example by the controller 120 or the nominal pump schedule module 202, but the implementation of ranges for the fracture control parameters 208 during interpretation of the fracture control parameters 208 may be separate from any limitations by the fracture limit criterion 212. The fracture constraint module 210 provides the fracture limit criterion 212 to the fracture optimization module 228.

In certain embodiments, the controller 120 further includes an environment description module 216 that interprets a plurality of environment parameters 218 including at least one uncertain parameter 220. The environment description module 216 further interprets an uncertainty description 222 for each uncertain parameter 220.

Environment parameters 218 include any parameters not within the ordinary sphere of control for a fracture treatment. For example, environment parameters 218 may include tubing and casing diameters, well depths, formation descriptions (e.g. in-situ stress, porosity, permeability, etc.) for each layer of the formation, rheology data for available fluids (e.g. viscosity descriptions, leakoff coefficients, etc.). In certain embodiments, the uncertain environment parameter(s) 220 include a reservoir layer thickness value, a reservoir layer temperature value, a Young's modulus value for a reservoir layer, a fracture toughness value for a reservoir layer, and/or a slip allowance at the interface between two reservoir layers. The slip allowance defines whether slip at the interface between two reservoir layers is allowed (i.e. modeled) or not allowed (i.e. not modeled). The values of any reservoir layer may be uncertain and of interest, for example the in-situ stress of a target production zone and of any barrier zones may all be of interest, and may be uncertain. In certain embodiments, the uncertain parameters 220 will be limited to a few of the more critical parameters, although a sensitivity analysis could be performed to determine which uncertain parameters 220 are more critical to analyze for optimization—i.e. which uncertain parameters 220 cause the greatest potential changes in the objective function 226 resulting from the variability due to uncertainty.

Environment parameters 218 may literally be controlled parameters (e.g. the tubing diameter) but where environment parameters 218 are controlled parameters, they are parameters that in the given context it is not desirable to alter. For example, the tubing string is controllable, but utilizing the same tubing diameters in multiple wells is a highly preferred practice. In certain embodiments, for example where the potential of a well is such that a cost of using a specific tubing size for the well is nominal, the tubing string may be a fracture control parameter 208 rather than an environmental parameter 218. Interpreting environment parameters 218 includes at least accepting user inputs, using default values, looking up data based on user inputs or defaults, and accepting network or datalink communications. Additionally, environment parameters 218 may be generated from tests (e.g. a miniature frac performed before a major treatment), log data, or the like.

In certain embodiments, the uncertainty description 222 is a statistical description of possible values for the corresponding uncertain environment parameter 220. For example, the uncertainty description 222 may be a probability distribution describing a range of values, or the uncertainty description 222 may be a list of discrete values for the uncertain environment parameter 220 with an estimate of the chances for each value. For example, a given reservoir layer in a field may have local natural micro-fractures, and it may be known that 25% of the time a low permeability value is present and 75% of the time a higher permeability value is present, with no other specific information available before a fracturing treatment is performed. In the example, the uncertainty description 222 is a 0.25 probability of $K_1$ (the low permeability) and a 0.75 probability of $K_2$ (the high permeability).

In one embodiment, the uncertainty description 222 is a mean and standard deviation describing a normal distribution (i.e. "Gaussian distribution") for the uncertain environment parameter 220. In certain embodiments, the uncertainty description 222 is a triangular probability distribution for the uncertain environment parameter 220, with a peak at the most likely occurrence value, and the slopes on the high and low side of the peak defined by known data around the variance of the uncertain environment parameter 220. In certain embodiments, the uncertainty description 222 includes a log normal distribution, a bimodal distribution, or any other distribution function or description based on available data for the parameter.

In certain embodiments, the controller 120 further includes an objective selection module 224 that defines an objective function 226. The objective function 226 defines the standard by which to "optimal" is defined for a specific embodiment. For example, economics are often important to a project and an NPV (e.g. over a specified period following the fracture treatment, for example, 365 days) may be used as the objective function 226. Other examples of objective functions 226 include a total hydrocarbon production at a specified time, which may be a total hydrocarbon production rate at a certain date, a total hydrocarbon production amount over a specified period following a fracture treatment, or any other hydrocarbon production criteria understood in the art.

Further examples of objective functions 226 include a hydrocarbon recovery amount (i.e. percentage recovery from the well spacing area), which may be the recovery of hydrocarbons from the well spacing area by a certain date, over a specified period following a fracture treatment, recovery over the life of the well, or any other recovery criteria understood in the art. In another example, near the completion of a field using a special proppant (e.g. sintered bauxite) that may not be otherwise utilized in the geographic area, it may be "optimal" to maximize hydrocarbon recovery per unit of proppant, thereby enabling maximum hydrocarbon recovery without ordering more of the proppant that is no longer needed, yielding an objective function 226 of hydrocarbon recovery per pound proppant. The examples provided are not intended to be limiting, as the possible objective function 226 criteria are numerous and project specific.

The controller 120 further includes a fracture optimization module 228 that determines an optimal value 230 for each fracture control parameter 208 according to the objective function 226, the environment parameters 218, and the uncertainty description 222.

In certain embodiments, the fracture optimization module 228 further constrains the optimal value 230 such that a simulated fracture is in accordance with the fracture limit criterion 212. For example, the pumping rate fracture control parameter 208 may have a nominal value 209 of 20 bbl/min, and the practitioner may allow the fracture optimization module 228 to determine a pumping rate between 10 bbl/min and 35 bbl/min (see, e.g., the lower bounds 410 and upper bounds 412 in the section referencing FIG. 4). In the example, assume the fracture limit criterion 212 indicates a maximum wellhead pressure of 7,500 psi, the fracture optimization module 228 determines that increasing pumping rate causes increasing NPV (the objective function 226 in the example) through the entire pumping rate range, but that the wellhead pressure exceeds 7,500 psi above 28 bbl/min. In the example, the fracture optimization module 228 limits the optimal value 230 of the pumping rate to 28 bbl/min, even though 35 bbl/min is allowed by the practitioner and would provide a higher NPV.

The example is provided merely to illustrate the effect of the fracture limit criterion 212, but is necessarily simplified and real situations are typically more complex. In a further example, if proppant concentration and fluid gel loading are also available as fracture control parameters 208, the fracture optimization module 228 also checks the state space of proppant concentrations and gel loadings to ensure the optimal values 230 are determined. In the further example, a reduction of gel loading (in some gel loading ranges) would decrease fluid viscosity and therefore reduce wellbore pressure, while an increase in proppant concentration may also reduce the wellbore pressure (due to hydraulic head changes), indicating that the fracture optimization module 228 may find a more complex set of optimal values 230, but while observing the fracture limit criterion 212.

In certain embodiments, the fracture optimization module 228 determines the optimal value 230 for each fracture control parameter 208 by defining a set of specific values for each uncertain environment parameter 220, and determining the optimal value 230 for each fracture control parameter 208 as the values that provide a best value from the objective function 226. The set of specific values for each uncertain environment parameter 220 are defined according to the uncertainty description 222 (e.g. as a statistical description of possible values) for the corresponding uncertain environment parameter 220. In certain embodiments, the set of specific values for each uncertain environment parameter 220 include a set of specific values approximating a distribution of values of the corresponding uncertain environment parameter 220, where the distribution of values of the corresponding uncertain environment parameter 220 is defined according to the uncertainty description 222.

For example, if the uncertainty description 222 is a plurality of discrete values, wherein the uncertain environment parameter 220 holds a first value 75% of the time and a second value 25% of the time, the fracture optimization module 228 defines the set of specific values such that 75% of the specific values are the first value and 25% of the specific values are the second value. In another example, if the uncertainty description 222 is a triangular probability distribution, the fracture optimization module 228 defines a relatively greater number of the specific values at values with near the peak occurrence, and a relatively smaller number of the specific values at values away from the peak occurrence. In another example, if the uncertainty description 222 is a normal probability distribution, the fracture optimization module 228 defines a varying number of values according to the distribution, such as about 64% of the values occurring within +/−1 standard deviation of the mean.

In certain embodiments, the fracture optimization module 228 selects a multiplicity of random specific values, each random specific value determined according to the uncertainty description 222. For example, a reservoir layer permeability may be uncertain, with an estimated mean value of 0.1 mD with a standard deviation of 0.05 mD, while the reservoir thickness may be uncertain, with an estimated mean value of 12 feet and a standard deviation of 0.5 feet. The fracture optimization module 228 may select 100 values of reservoir layer permeabilities determined according to a Gaussian distribution defined by the mean value of 0.1 mD with a standard deviation of 0.05 mD, and randomly pair those values to 100 values of reservoir thickness determined according to a Gaussian distribution defined by the mean value of 12 feet and a standard deviation of 0.5 feet (e.g. as a Monte Carlo style simulation).

In certain embodiments, the fracture optimization module 228 selects specific values that are only representative of the distribution. For example, the fracture optimization module 228 may select 5 values of each uncertain environment parameter 220 that provide a representation of the unknown scatter in the parameter 220. For example, where the uncertain environment parameter 220 comprises a porosity mean value of 12% porosity, with a standard deviation of 2%, the fracture optimization module 228 may select values of 14.5%, 13.3%, 12%, 10.7%, and 9.4% as specific values for simulation with the porosity value. The five selected points in the example are the 90%, 75%, 50%, 25%, and 10% cumulative distribution points for the Gaussian distribution having a mean and standard deviation of 0.12 and 0.02 respectively. The example points are shown merely for illustration, and the selection of points for a given embodiment, including the number and value of the points, are selections dependent upon the risks and other factors specific to a given embodiment of the present application.

In certain embodiments, the fracture optimization module 228 determines the outputs of the objective function 226 according to the specific values for the uncertain parameters 220. In one example, the reservoir layer porosity is the unknown environment parameter 220, and the fracture optimization module 228 selects the values 14.5%, 13.3%, 12%, 10.7%, and 9.4% as specific values representative of the uncertainty description 222 for the reservoir layer porosity. In the example, the objective function 226 is an NPV over a 180-day period following the fracture treatment. The fracture optimization module 228 iterates through the state space of potential fracture control parameter 208 values, determining which set of fracture control parameter 208 values provide the best NPV value across the range of reservoir layer porosity values. In the example, a first pump rate 25 bbl/min provides a mean and std. dev. NPV of $1,000,000 and $25,000 (respectively) while a second pump rate 50 bbl/min provides a mean and std. dev. NPV of $1,100,000 and $80,000. If the best NPV value is defined (by a practitioner, by default, or by a response to a prompt at the display device 122) as the greatest mean value, then the second pump rate is determined to provide a superior NPV value to the first pump rate. If the best NPV value is defined as the mean value less two standard deviations, then in the example the first pump rate is determined to provide a superior NPV value to the second pump rate.

The operations of optimizing the pump schedule can follow standard optimization techniques. For one example, a set of values for the fracture control parameters 208 may be checked and an NPV determined. If a next iteration from the set of values for the fracture control parameters 208 improves the NPV by a threshold amount, then the pump schedule is not determined to be optimized and another iteration is performed. If the next iteration of the set of values for the fracture control parameters 208 does not improve the NPV by the threshold amount, then the pump schedule is determined to be optimized and another iteration is not performed. Standard checks may further be utilized to ensure that the optimization is not merely a local optimum (e.g. ensuring that a significant portion of the fracture control parameter 208 allowable space is tested, etc.). The performance of such an optimization is within the skill of one in the art based with the disclosures herein, and further detail is not provided to avoid obscuring aspects of the present application.

The NPV may be determined according to expected production increases due to a fracture treatment, the cost of the fracture treatment, and the expected discount rates for money or the return on alternate available investments. Determining the cost of a fracture treatment is a mechanical step for one of skill in the art, and in one example can be made based on price book data stored in a computer readable format. The NPV determinations for injection wells can be made based on benefits from injection cost reductions, predicted benefits from offset well production increases, or similar parameters defining the benefits of the fracture treatment for the injection well.

In certain embodiments, the best value of the objective function 226 is the greatest mean value, e.g. the greatest mean NPV. In certain embodiments, the best value of the objective function 226 is the objective function 226 result with the lowest standard deviation, or the objective function 226 result with the highest risk-adjusted value. The highest risk-adjusted value indicates the value which, given a variance below the mean, provides the most desirable outcome. Consider a first value of the objective function 226 with a mean value of $200,000 NPV and standard deviation of $50,000 NPV, and a second value of the objective function 226 with a mean value of $175,000 NPV and a standard deviation of $20,000 NPV. Based on the greatest mean NPV, the first value of the objective function 226 would be optimal, and therefore the optimal value 230 would be whatever set of values for the fracture control parameters 208 yielded the first value of the objective function 226.

Based on a lowest downside risk evaluation with a 1 standard deviation variance below the mean, the first value of the objective function 226 has a risk adjusted value of $150,000 (i.e. $200k−$50k) and the second value of the objective function 226 has a risk adjusted value of $155,000 (i.e. $175k−$20k), and therefore the optimal value 230 would be whatever set of values for the fracture control parameters 208 yielded the second value of the objective function. The highest risk-adjusted value can be evaluated at a point λ, which may be selected by a practitioner and utilized as in the expression $F=\mu-\lambda\sigma$. In the expression, F is the objective function 226 result for comparison, μ is the mean value, σ is the standard deviation value, and λ is a risk aversion factor indicating the limit of acceptable risk.

In certain embodiments, the fracture control parameters 208 comprise multipliers for pump schedule values and/or pump schedule values directly.

In one example, the nominal pump schedule module 202 interprets a nominal pump schedule 204 including stage-by-stage values, and the pumping rates, proppant concentrations, and fluid volumes have global multipliers nominally equal to one (1). The fracture control parameters 208 in the example include the global multipliers, and the fracture optimization module 228 adjusts the nominal pump schedule 204 by changing the global multipliers. For example, the nominal pump schedule 204 may include a pumping rate of 30 bbl/min and proppant concentration stages of 1.0 pounds proppant added (PPA) to 5.0 PPA in 1 PPA increments. In the example, assume the fracture optimization module 228 determines a multiplier of 1.5 is the optimal value 230 for the pump rate, while a multiplier of 0.95 is the optimal value 230 for the proppant concentrations. In the example, the fracture optimization module 228 calculates a modified pump schedule 232 based on the nominal pump schedule 204 and the optimal values 230 for each fracture control parameter 208. The modified pump schedule 232 in the example includes a pumping rate of 45 bbl/min and proppant concentration stages of 0.95 PPA to 4.75 PPA in 0.95 PPA increments.

In one example, the nominal pump schedule module 202 interprets the nominal pump schedule 204 by calculating intermediate quantities 206 from a nominal pump rate, a proppant maximum concentration, and a total proppant mass, and further interprets the nominal pump schedule 204 by generating an analytical nominal pump schedule 204 from the intermediate quantities 206. In the example, the fracture optimization module 228 calculates the stage sizes and combines stages with similar proppant sizes to determine optimal values 230 for the fracture control parameters 208 (all pumping rates, proppant concentrations, and fluid volumes in this example). One of skill in the art will recognize that an analytically determined pumping schedule allows the number of proppant stages to be a fracture control parameter 208. The fracture optimization module 228 may be constrained to generate a pumping schedule with features such as monotonically increasing proppant concentration, constant pumping rate, and so forth according to known best practices and practical constraints. The fracture optimization module 228 may calculate the modified pumping schedule 232 based on the optimal values 230 for the fracture control parameters 208.

In certain embodiments, the controller 120 includes a report module 234 that provides information to a display device 122, that records information to a memory location, and/or that communicates information over a network or other communication device. The information includes the optimal values 230, the modified pump schedule 232, a limit indicator value 236 indicating whether a fracture limit criterion 212 constrained the optimal values 230, the nominal pumping schedule 204, and/or the objective function results 238. In certain embodiments, the fracture optimization module 228 calculates the 232 modified pump schedule based on the nominal pump schedule 204 and the optimal values 230 for each fracture control parameter 208, and determines a limit indicator value 236 indicating whether the optimal value 230 for the fracture control parameter 208 is constrained by the fracture limit criterion 212. In certain further embodiments, the report module 234 generates a report including: the nominal pump schedule 204, the modified pump schedule 232, a result of the objective function 238, and the limit indicator value 236.

FIG. 3 is a first illustration 300 of a nominal pump schedule 204 corresponding to a nominal value 209 for each fracture control parameter 208. In the embodiment illustrated in FIG. 3, the nominal values 209 comprise multipliers 310. The nominal pump schedule 204 includes parameters that are not considered control variables and parameters that are considered control variables (i.e. fracture control parameters 208). The parameters that are considered control variables vary with the specific embodiment, for example where the closure pressure of a formation requires sintered bauxite, the proppant type may not be a fracture control parameter 208 but rather just a part of the nominal pump schedule 204. In certain embodiments, the pumping rate 302, proppant concentration 304, and fluid volume 306 are fracture control parameters 208. Certain fluid properties such as gel concentration 308 and additives such as breaker loading (1 lbs J475/Mgal in the example of FIG. 3, not shown in an independent column) may be fracture control parameters 208.

In certain embodiments, the fracture control parameters 208 are controlled by adjusting a multiplier 310. In the embodiment illustrated in FIG. 3, the pumping rate 302 has a global multiplier ("A") applied to all stages 312, the proppant concentration 304 has a global multiplier ("B") applied to all stages 312 having proppant, and the fluid volume has individual multipliers for each stage ("C1 . . . C9") 312. Although applying the same pumping rate 302 to all stages is typical in practice, it is contemplated that in some embodiments a stage-by-stage pumping rate 302 adjustment may be applied. For example, the pumping rate 302 may be slowed near the end of a fracture treatment during an intentional screenout, and the fracture limit criterion 212 may drive the optimal values 230 toward a reduced pumping rate 302 in later stages (e.g. especially the flush). The volume of the flush is generally constant and defined by the tubing and casing configuration. Where the tubing diameter (not shown) is included as a fracture control parameter 208, the fracture optimization module 218 changes the flush volume to ensure an appropriate flush stage is calculated. The flush volume affects the cost of the fracture treatment, and therefore affects the NPV analysis where NPV is utilized as the objective function 226.

The gel concentration 308 is typically held constant as a practical matter. However, real-time gel hydration devices are known in the art, and gel concentration 308 is allowed to vary by stage in certain embodiments, for example to lower fluid viscosity and limit fracture height growth. A fracture limit criterion 212 determining how quickly gel loading 308 may be changed accommodates any limitations of a real-time hydration device to ensure a fracture treatment with optimal values 230 is also a fracture treatment that can realistically be performed.

FIG. 4 is an illustration 400 of user inputs 205 for a nominal pump schedule 204 corresponding to a nominal value 209 for each fracture control parameter 208. The user inputs 205 include parameter values 401, including a pump rate 402, a total proppant mass 404, a maximum proppant concentration 406, and a total injected volume 408. The inputs 400 further include lower bounds 410 and upper bounds 412 for the parameter values 401.

In certain embodiments, the fracture optimization module 228 explores the state space of the inputs 401 within the lower bounds 410 and upper bounds 412 for the parameters 401. However, the lower bounds 410 and upper bounds 412 for the parameters 401 are not the same as the fracture limit criterion 212. The fracture limit criterion 212 may be any parameter value constraint, and may be related to the fracture control parameters 208 or the user inputs 205, but may also be unrelated to the fracture control parameters 208 or the user inputs 205. For example, a maximum height growth of a fracture in the reservoir is appropriate for a fracture limit criterion 212, but is not a value available for a lower bound 410 or upper bound 412. The lower bounds 410 and upper bounds 412 are specifically associated with the user inputs 205. The user inputs 205 may be provided by a user, determined from a previous fracture treatment, determined according to rules of thumb, or by any other means understood in the art.

FIG. 5A is an illustration 500 of a set of intermediate quantities 206 consistent with the user inputs 205 for interpreting a nominal pump schedule as illustrated in FIG. 4. The expressions 502 define a set of intermediate quantities 206 that are helpful in determining a nominal pump schedule 204 based on the user inputs 205, as described in Meng. The expressions 502 illustrated in FIG. 5 are sufficiently independent. In certain embodiments, the analytical nominal pump schedule 204, shown partially in FIG. 5, utilizes the pad volume 506, and ramps the proppant concentration 508 smoothly from zero to the maximum proppant concentration at a rate such that the average proppant concentration 510 is achieved during the treatment.

The nominal pump schedule 204 (refer to FIG. 5B) is segmented into small arbitrarily indexed stages 512 (each representing 4 bbls injected volume in the example), allowing the nominal pump schedule module 202 to either leave the nominal pump schedule 204 in the indexed stages 512, or to lump indexed stages 512 together into coarse stages 514 having similar proppant loading. For example, the stages 514 are calculated based on the proppant concentration 516 having a value of INT(Cp(t)+/−x) where x is less than half the coarse stage 514 difference and Cp(t) is the specific proppant concentration of an indexed stage 512 at time "t". In the example of FIG. 5, "x" has a value of 0.3. Therefore, the indexed stage 2 with Cp(t)=0.672 is put in the "0" coarse stage 514, while the indexed stages 3-8, having Cp(t) between 0.929 and 1.669 are put into the "1" coarse stage 514. In alternate embodiments, the coarse stages 514 may be omitted, set to coarser values (e.g. 0 PPA, 2 PPA, etc.), and/or set to finer values (e.g. 0 PPA, 0.5 PPA, 1.0 PPA, 1.5 PPA, etc.).

The nominal pump schedule 204 of FIG. 5B includes many stages that may be lumped together in whole or part, prior to optimization, after optimization, or used in the entirety. Further, during optimization constraints may be applied to allowed adjustments by the fracture optimization module 228. For example, the proppant concentration 516 values may be enforced to be monotonically increasing, the pump rates may be enforced to have the same value, etc. The analytical method for generating a nominal pump schedule 204 is shown for illustration only, and any method for generating a nominal pump schedule known in the art is contemplated within the scope of the present application.

FIG. 6 is a first illustration 600 of a modified pump schedule 232 consistent with the first illustration 300 of a nominal pump schedule 204. In the illustration of FIG. 6, the fracture control parameters 208 are the pump rate 602, the fluid volume 604, and the proppant concentration 606. The nominal values 209 comprise a multiplier of 1.0 for each fracture control parameter 208, with upper bounds 608 and lower bounds 610 provided having values of 3.0 and 0.5, respectively. The fracture optimization module 228, for purposes of illustration, determines that the optimal values 230A, 230B, 230C comprise a value 230A of 1.1 for the proppant concentration multiplier, a value 230B of 1.1 for the fluid volume multiplier, and a value 230C of 1.2 for the pump rate multiplier. The fracture optimization module 228 further determines a modified pump schedule 232 based on the nominal pump schedule 204 and the optimal values 230A, 230B, 230C for each of the fracture control parameters 208.

FIG. 7 is a second illustration 700 of a modified pump schedule 232 consistent with the second illustration 500 of a nominal pump schedule 204. The fracture optimization module 228 determines optimal values 230 for the pump rates, fluid volumes, and proppant mass, and adjusts the nominal pump schedule 204 according to the optimal values 230 to determine the modified pump schedule 232. The fracture optimization module 228, in the embodiment illustrated in FIG. 7, has lumped the indexed stages 512 into 1 PPA coarse stages 514, either before or after performing the optimization. In the illustration, the user inputs 205 (see FIG. 4) initially entered a pumping rate of 20 bbl/min, a total proppant mass of 162,000#, a maximum proppant concentration of 8.0 PPA, and a total injected volume of 1,493 bbl (62,700 gal). The fracture optimization module 228, in the illustration, determined optimal values of a pumping rate of 20 bbl/min, a total proppant mass of 139,255#, a maximum proppant concentration of 8.0 PPA, and a total injected volume of 1,493 bbl. The fracture optimization module 228 further determined the modified pump schedule 232 as illustrated in FIG. 7.

Figure 8A:
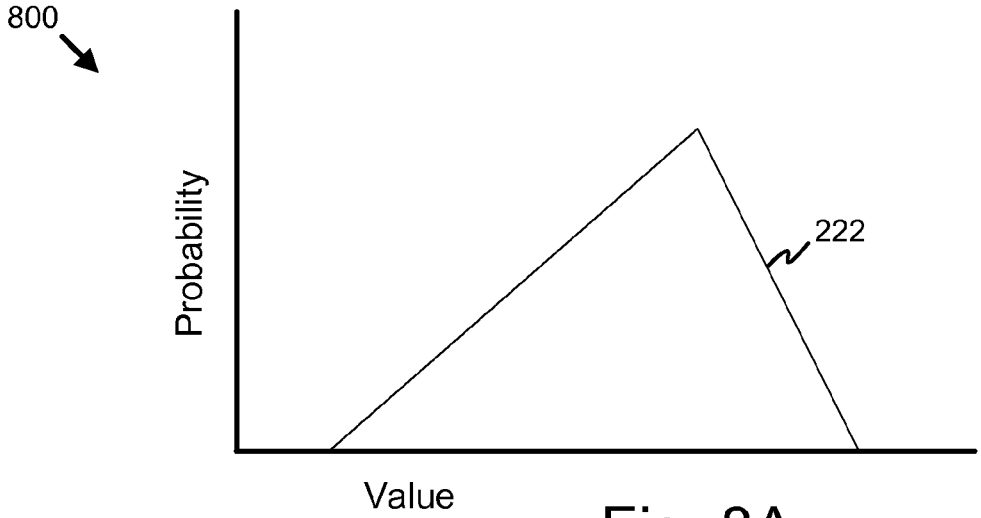
FIG. 8A is a first illustration of an uncertainty description corresponding to an uncertain environment parameter.

FIG. 8A is a first illustration 800 of an uncertainty description 222 corresponding to an uncertain environment parameter 220. The illustration 800 shows an uncertainty description 222 comprising a triangular distribution for an uncertain environment parameter 220. The triangular distribution may be useful, without limitation, where a best guess value is available, and the potential uncertainty is relatively bounded.

Figure 8B:
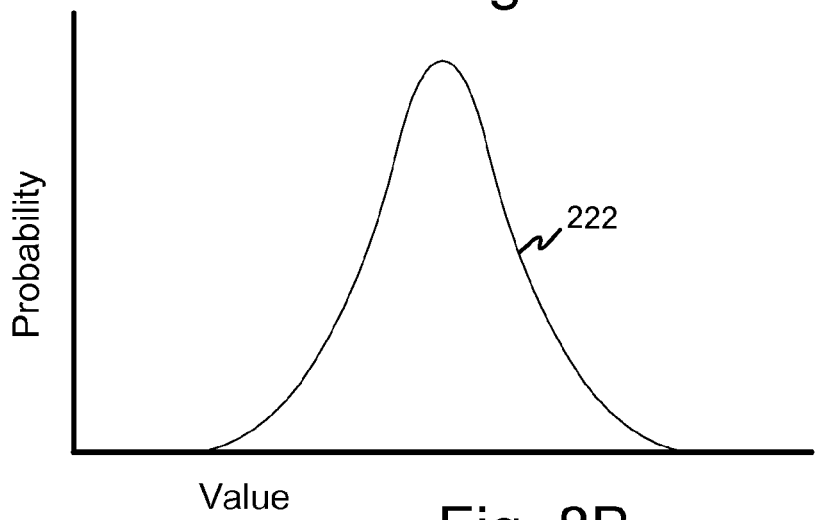
FIG. 8B is a second illustration of an uncertainty description corresponding to an uncertain environment parameter.

FIG. 8B is a second illustration 801 of a uncertainty description corresponding to an uncertain environment parameter 220. The illustration 801 shows an uncertainty description 222 comprising a normal distribution for an uncertain environment parameter 220. The normal distribution may be useful, without limitation, where a large number of data samples are available and the data appears to approximate a normal distribution curve, or where some data is available to estimate a mean and probable scatter of data values.

Figure 8C:
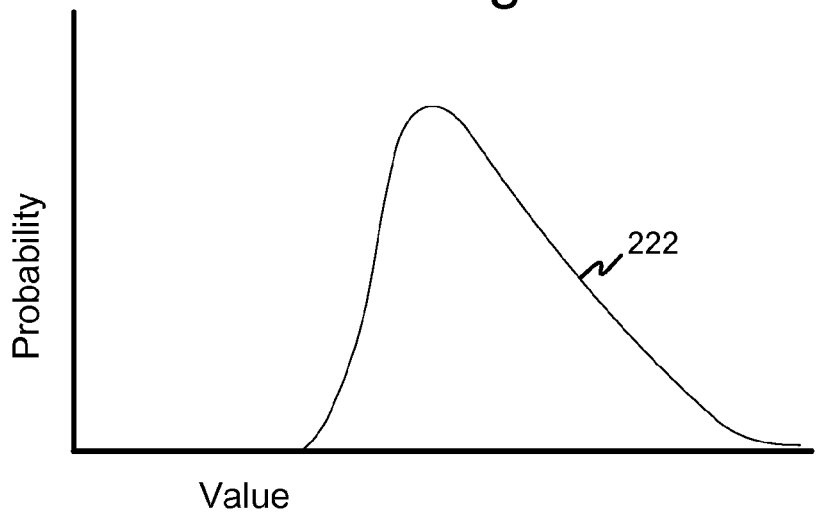
FIG. 8C is a third illustration of an uncertainty description corresponding to an uncertain environment parameter.

FIG. 8C is a third illustration 802 of a uncertainty description 222 corresponding to an uncertain environment parameter 220. The illustration 802 shows an uncertainty description 224 comprising a log-normal distribution for an uncertain environment parameter 220. The log-normal distribution may be useful, without limitation, where a large number of data samples are available and the data appears to approximate a log-normal distribution curve, or where some data is available to estimate a mean and probable directional scatter of data values.

Figure 9:
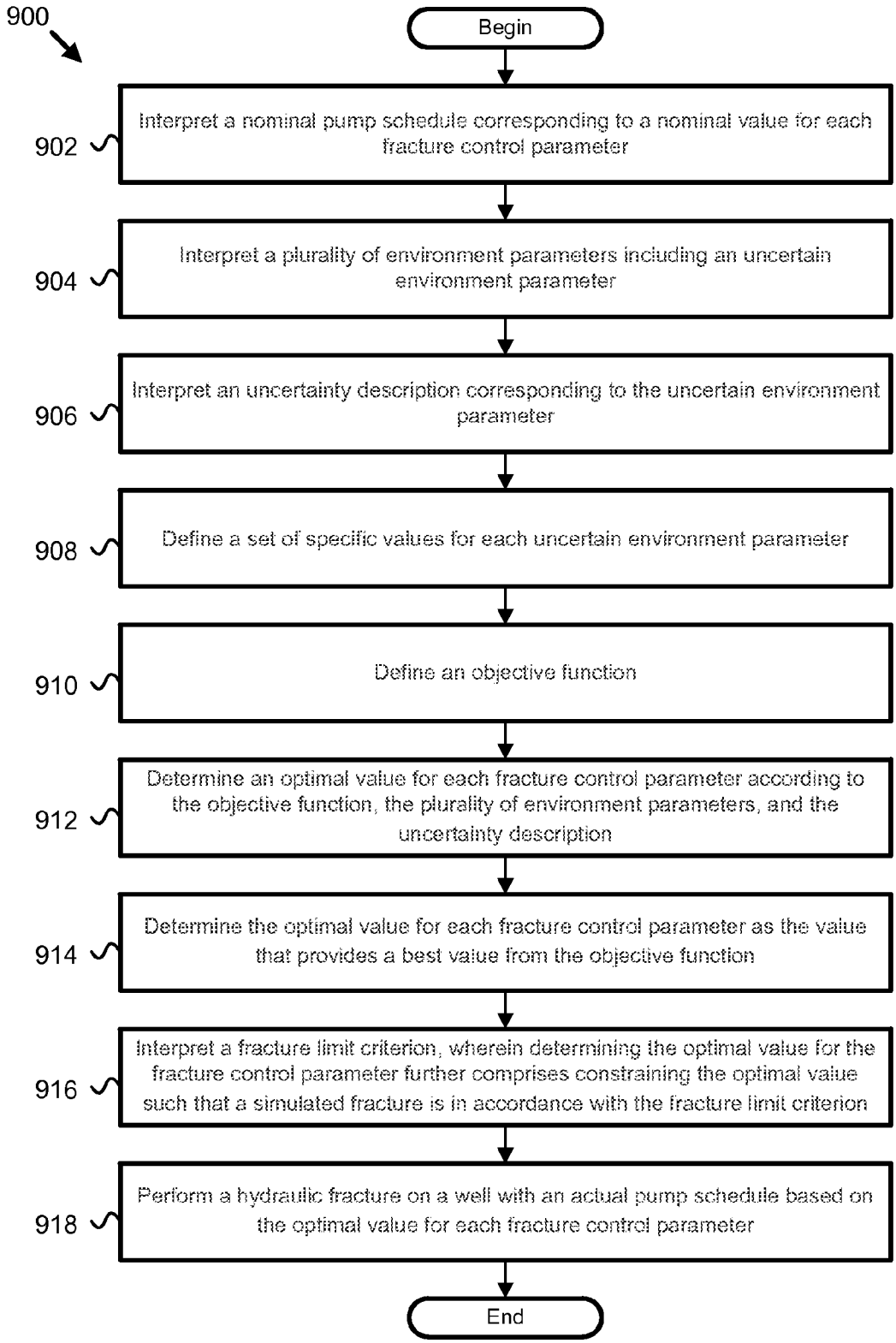
FIG. 9 is a schematic flow chart diagram of a method for fracture optimization.

FIG. 9 is a schematic flow chart diagram of a method 900 for fracture optimization. The method 900 may be performed, at least in part, as computer operations directed by a computer program product on a computer readable medium, for example as computer program instructions stored on a storage device and executable by a computer processor. The method 900 includes an operation 902 interpreting a nominal pump schedule corresponding to a nominal value for each fracture control parameter. The method 900 further includes an operation 904 interpreting a plurality of environment parameters including an uncertain environment parameter, and an operation 906 interpreting an uncertainty description, the uncertainty description corresponding to the uncertain environment parameter. In certain further embodiments, the method 900 includes an operation 908 determining an optimal value for each at least one fracture control parameter includes an operation 912 defining a set of specific values for each uncertain environment parameter.

The method 900 further includes an operation 910 defining an objective function and an operation 912 determining an optimal value for each fracture control parameter according to: the objective function, the plurality of environment parameters, and the at least one uncertainty description. The method 900 further includes an operation 914 determining the optimal value for each at least one fracture control parameter as the value that provides a best value from the objective function.

In certain embodiments, the method further includes an operation 916 interpreting a fracture limit criterion, wherein determining the optimal value for the fracture control parameter further comprises constraining the optimal value such that a simulated fracture is in accordance with the fracture limit criterion. In certain embodiments, the method includes an operation 918 performing a hydraulic fracture on a well with an actual pump schedule based on the optimal value for each fracture control parameter.

Figure 10:
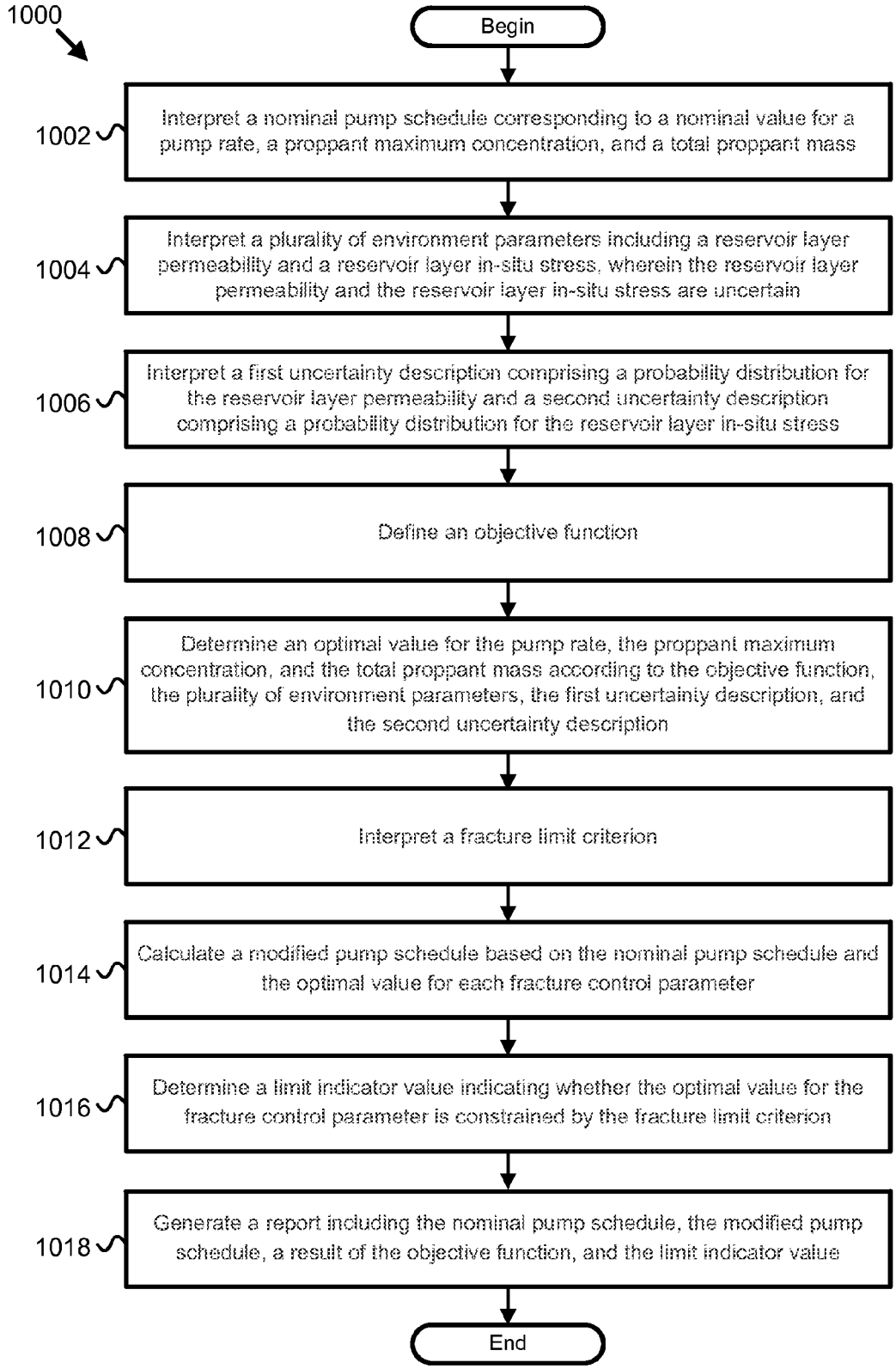
FIG. 10 is a schematic flow chart diagram of one embodiment of a method for fracture optimization.

FIG. 10 is a schematic flow chart diagram of one embodiment of a method 1000 for fracture optimization. The method 1000 may be performed, at least in part, as computer operations directed by a computer program product on a computer readable medium, for example as computer program instructions stored on a storage device and executable by a computer processor. Certain embodiments include an operation 1002 interpreting a nominal pump schedule corresponding to a nominal value for each of a pump rate, a proppant maximum concentration, and a total proppant mass. In certain further embodiments, the method includes an operation 1004 interpreting a plurality of environment parameters including a reservoir layer permeability and a reservoir layer in-situ stress, wherein the reservoir layer permeability and the reservoir layer in-situ stress are uncertain. In certain further embodiments, the method includes an operation 1006 interpreting a first uncertainty description comprising a probability distribution for the reservoir layer permeability and a second uncertainty description comprising a probability distribution for the reservoir layer in-situ stress. In certain embodiments, the method includes an operation 1008 defining an objective function and an operation 1010 determining an optimal value for the pump rate, the proppant maximum concentration, and the total proppant mass according to: the objective function, the plurality of environment parameters, the first uncertainty description, and the second uncertainty description.

In certain further embodiments, the method includes an operation 1012 interpreting a fracture limit criterion, wherein the operation 1010 determining the optimal value for the fracture control parameter further includes constraining the optimal value such that a simulated fracture is in accordance with the fracture limit criterion. In certain further embodiments, the method further includes an operation 1014 calculating a modified pump schedule based on the nominal pump schedule and the optimal value for each fracture control parameter, an operation 1016 determining a limit indicator value indicating whether the optimal value for the fracture control parameter is constrained by the fracture limit criterion, and an operation 1018 generating a report including: the nominal pump schedule, the modified pump schedule, a result of the objective function, and the limit indicator value.

As is evident from the figures and text presented above, a variety of embodiments according to the present invention are contemplated.

Certain embodiments include a system comprising a controller. The controller includes a nominal pump schedule module configured to interpret a nominal pump schedule corresponding to a nominal value for each at least one fracture control parameter. The controller further includes an environment description module configured to interpret a plurality of environment parameters including at least one uncertain parameter, the environment description module further configured to interpret at least one uncertainty description, each uncertainty description corresponding to one of the uncertain environment parameters. The controller further includes an objective selection module configured to define an objective function, and a fracture optimization module configured to determine an optimal value for each at least one fracture control parameter according to: the objective function, the plurality of environment parameters, and the at least one uncertainty description. The controller further includes a fracture planning module configured to calculate a modified pump schedule based on the nominal pump schedule and the optimal value for each at least one fracture control parameter. The controller further includes a fluid mixing means that prepares a fracturing fluid according to the modified pump schedule, and a pumping means that pumps the prepared fracturing fluid into a well according to the modified pump schedule.

In certain embodiments of the system, the fracturing fluid comprises one of a hydraulic fracturing fluid and an acid fracturing fluid. In certain further embodiments, the objective function comprises a net present value (NPV), a total hydrocarbon production at a specified time, and/or a hydrocarbon recovery amount. In certain further embodiments, the system includes a display means that shows a first simulated fracture according to the nominal pumping schedule and a second simulated fracture according to the modified pump schedule.

Certain embodiments include a method comprising interpreting a nominal pump schedule corresponding to a nominal value for each of at least one fracture control parameter. The method further includes interpreting a plurality of environment parameters including at least one uncertain environment parameter, and interpreting at least one uncertainty description, each uncertainty description corresponding to one of the uncertain environment parameters. The method further includes defining an objective function and determining an optimal value for each at least one fracture control parameter according to: the objective function, the plurality of environment parameters, and the at least one uncertainty description.

In certain further embodiments, the method includes performing a hydraulic fracture on a well with an actual pump schedule based on the optimal value for each at least one fracture control parameter. In certain further embodiments, the method further includes interpreting a fracture limit criterion, wherein determining the optimal value for the fracture control parameter further comprises constraining the optimal value such that a simulated fracture is in accordance with the fracture limit criterion. In certain further embodiments, each uncertainty description comprises a statistical description of possible values for the corresponding uncertain environment parameter. In certain further embodiments, the uncertainty descriptions include a plurality of discrete values, a mean value and a standard deviation, a triangular probability distribution, and a probability distribution function.

In certain further embodiments, determining an optimal value for each at least one fracture control parameter includes defining a set of specific values for each uncertain environment parameter, and determining the optimal value for each at least one fracture control parameter as the value that provides a best value from the objective function. In certain embodiments, the best value from the objective function comprises a greatest mean net present value (NPV). In certain further embodiments, each uncertainty description comprises a statistical description of possible values for the corresponding uncertain environment parameter, and wherein the set of specific values for each uncertain environment parameter are defined according to the statistical description of possible values for the corresponding uncertain environment parameter.

In certain further embodiments, the uncertainty descriptions include a plurality of discrete values, a mean value and a standard deviation, a triangular probability distribution, and/or a probability distribution function. In certain embodiments, the set of specific values for each uncertain environment parameter includes a set of specific values approximating a distribution of values of the corresponding uncertain environment parameter, wherein the distribution of values is defined according to the at least one uncertainty description. The set of specific values for each uncertain environment parameter may include a multiplicity of random specific values, each random specific value determined according to the uncertainty description.

In certain further embodiments, the uncertain environment parameter(s) include an in-situ stress value for a reservoir layer, a permeability value for a reservoir layer, and/or a reservoir layer porosity value. In certain further embodiments, the uncertain environment parameter includes an in-situ stress value for a reservoir layer, a permeability value for a reservoir layer, a reservoir layer thickness value, a reservoir layer porosity value, a reservoir layer temperature value, a Young's modulus value for a reservoir layer, a fracture toughness value for a reservoir layer, and/or a slip allowance at the interface between two reservoir layers. In certain embodiments, the fracture control parameters include a fluid pump rate, at least one fluid volume value, and at least one proppant concentration value. In certain embodiments, the fracture control parameters include a fluid selection, a proppant selection, a gel loading value, and/or an acid concentration value. In certain embodiments, the nominal value for each fracture control parameter comprises one of a multiplier and a fracture control parameter value.

Certain embodiments include a method comprising interpreting a nominal pump schedule corresponding to a nominal value for each of a pump rate, a proppant maximum concentration, and a total proppant mass. In certain further embodiments, the method includes interpreting a plurality of environment parameters including a reservoir layer permeability and a reservoir layer in-situ stress, wherein the reservoir layer permeability and the reservoir layer in-situ stress are uncertain. In certain further embodiments, the method includes interpreting a first uncertainty description comprising a probability distribution for the reservoir layer permeability and a second uncertainty description comprising a probability distribution for the reservoir layer in-situ stress. The method further includes defining an objective function and determining an optimal value for the pump rate, the proppant maximum concentration, and the total proppant mass according to: the objective function, the plurality of environment parameters, the first uncertainty description, and the second uncertainty description.

In certain further embodiments, the objective function includes a member selected from the group consisting of a net present value (NPV), a total hydrocarbon at a specified time, and a hydrocarbon recovery amount. In certain further embodiments, determining an optimal value for the pump rate, the proppant maximum concentration, and the total proppant mass comprises defining a set of specific values for each of the reservoir layer permeability and the reservoir layer in-situ stress, and determining the optimal value for the pump rate, the proppant maximum concentration, and the total proppant mass as the values that provide a best value from the objective function. In certain embodiments, the best value from the objective function includes a greatest mean value, a lowest standard deviation value, and/or a highest risk-adjusted value.

In certain embodiments, an apparatus includes a nominal pump schedule module that interprets a nominal pump schedule corresponding to a nominal value for each of at least one fracture control parameter, and an environment description module that interprets environment parameters including an uncertain parameter. In certain further embodiments, the environment description module interprets an uncertainty description, each uncertainty description corresponding to one of the uncertain environment parameters. In certain embodiments, an objective selection module defines an objective function, and a fracture optimization module determines an optimal value for each fracture control parameter according to the objective function, the plurality of environment parameters, and/or the uncertainty description.

In certain further embodiments, a fracture constraint module interprets a fracture limit criterion, and the fracture optimization module constrains the optimal value such that a simulated fracture is in accordance with the fracture limit criterion. In certain further embodiments, each uncertainty description includes a statistical description of possible values for the corresponding uncertain environment parameter. The uncertainty descriptions in certain embodiments include a plurality of discrete values, a mean value and a standard deviation, a triangular probability distribution, and/or a probability distribution function.

In certain embodiments, each uncertainty description includes a statistical description of possible values for the corresponding uncertain environment parameter, and the fracture optimization module determines the optimal value for each fracture control parameter by defining a set of specific values for each uncertain environment parameter. In certain further embodiments, the set of specific values for each uncertain environment parameter are defined according to the statistical description of possible values for the corresponding uncertain environment parameter. In certain further embodiments, the set of specific values for each uncertain environment parameter includes a multiplicity of random specific values, each random specific value determined according to the uncertainty description. In certain further embodiments, the fracture optimization module determines the optimal value for each fracture control parameter as the value that provides a best value from the objective function.

In certain embodiments, the uncertain environment parameter includes an in-situ stress value for a reservoir layer, a permeability value for a reservoir layer, a reservoir layer thickness value, a reservoir layer porosity value, a reservoir layer temperature value, a Young's modulus value for a reservoir layer, a fracture toughness value for a reservoir layer, and/or a slip allowance at the interface between two reservoir layers.

In certain embodiments, a computer program product on a computer readable medium that, when performed on a controller in a computerized device provides a method for performing the operations of interpreting a nominal pump schedule corresponding to a nominal value for each fracture control parameter, interpreting a plurality of environment parameters including an uncertain environment parameter, interpreting an uncertainty description, the uncertainty description corresponding to the uncertain environment parameter, defining an objective function, determining an optimal value for each fracture control parameter according to: the objective function, the plurality of environment parameters, and the uncertainty description. In certain further embodiments, the computer program product further provides a method for performing the operations of calculating a modified pump schedule based on the nominal pump schedule and the optimal value for each fracture control parameter. In certain further embodiments, the computer program product further provides a method for performing the operations of generating a report including: the nominal pump schedule, the modified pump schedule, and a result of the objective function.

In certain further embodiments, the computer program product further provides a method for performing the operations of interpreting a fracture limit criterion, wherein determining the optimal value for the fracture control parameter further includes constraining the optimal value such that a simulated fracture is in accordance with the fracture limit criterion. In certain further embodiments, the computer program product further provides a method for performing the operations of calculating a modified pump schedule based on the nominal pump schedule and the optimal value for each fracture control parameter, determining a limit indicator value indicating whether the optimal value for the fracture control parameter is constrained by the fracture limit criterion, and generating a report including: the nominal pump schedule, the modified pump schedule, a result of the objective function, and the limit indicator value.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

interpreting a nominal pump schedule corresponding to a nominal value for each of at least one fracture control parameter;

interpreting a plurality of environment parameters including at least one uncertain environment parameter;

interpreting at least one uncertainty description, each uncertainty description corresponding to one of the uncertain environment parameters;

defining an objective function; and determining an optimal value for each at least one fracture control parameter according to: the objective function, the plurality of environment parameters, and the at least one uncertainty description.

2. The method of claim 1, further comprising performing a hydraulic fracture on a well with an actual pump schedule based on the optimal value for each at least one fracture control parameter.

3. The method of claim 1, further comprising interpreting a fracture limit criterion, wherein determining the optimal value for the fracture control parameter further comprises constraining the optimal value such that a simulated fracture is in accordance with the fracture limit criterion.

4. The method of claim 1, wherein each uncertainty description comprises a statistical description of possible values for the corresponding uncertain environment parameter.

5. The method of claim 4, wherein at least one of the uncertainty descriptions comprises a member selected from the group consisting of: a plurality of discrete values, a mean value and a standard deviation, a triangular probability distribution, and a probability distribution function.

6. The method of claim 1, wherein determining an optimal value for each at least one fracture control parameter comprises defining a set of specific values for each uncertain environment parameter, and determining the optimal value for each at least one fracture control parameter that provides a best value from the objective function.

7. The method of claim 6, wherein the best value from the objective function comprises a greatest mean net present value (NPV).

8. The method of claim 6, wherein each uncertainty description comprises a statistical description of possible values for the corresponding uncertain environment parameter, and wherein the set of specific values for each uncertain environment parameter are defined according to the statistical description of possible values for the corresponding uncertain environment parameter.

9. The method of claim 8, wherein at least one of the uncertainty descriptions comprises a member selected from the group consisting of: a plurality of discrete values, a mean value and a standard deviation, a triangular probability distribution, and a probability distribution function.

10. The method of claim 9, wherein the set of specific values for each uncertain environment parameter comprise a set of specific values approximating a distribution of values of the corresponding uncertain environment parameter, wherein the distribution of values is defined according to the at least one uncertainty description.

11. The method of claim 9, wherein the set of specific values for each uncertain environment parameter comprise a multiplicity of random specific values, each random specific value determined according to the uncertainty description.

12. The method of claim 1, wherein the at least one uncertain environment parameter comprises at least one member selected from the group consisting of: an in-situ stress value for a reservoir layer, a permeability value for a reservoir layer, and a reservoir layer porosity value.

13. The method of claim 1, wherein the at least one uncertain environment parameter comprises at least one member selected from the group consisting of: an in-situ stress value for a reservoir layer, a permeability value for a reservoir layer, a reservoir layer thickness value, a reservoir layer porosity value, a reservoir layer temperature value, a Young's modulus value for a reservoir layer, a fracture toughness value for a reservoir layer, and a slip allowance at the interface between two reservoir layers.

14. The method of claim 1, wherein the at least one fracture control parameter comprises at least one member selected from the group consisting of: a fluid pump rate, at least one fluid volume value, and at least one proppant concentration value.

15. The method of claim 1, wherein the at least one fracture control parameter comprises at least one member selected from the group consisting of: a fluid selection, a proppant selection, a gel loading value, and an acid concentration value.

16. The method of claim 1, wherein the nominal value for each at least one fracture control parameter comprises one of a multiplier and a fracture control parameter value.

17. A method, comprising:

interpreting a nominal pump schedule corresponding to a nominal value for each of a pump rate, a proppant maximum concentration, and a total proppant mass;

interpreting a plurality of environment parameters including a reservoir layer permeability and a reservoir layer in-situ stress, wherein the reservoir layer permeability and the reservoir layer in-situ stress are uncertain;

interpreting a first uncertainty description comprising a probability distribution for the reservoir layer permeability and a second uncertainty description comprising a probability distribution for the reservoir layer in-situ stress;

defining an objective function; and determining an optimal value for the pump rate, the proppant maximum concentration, and the total proppant mass according to: the objective function, the plurality of environment parameters, the first uncertainty description, and the second uncertainty description.

18. The method of claim 17, wherein the objective function comprises a member selected from the group consisting of a net present value (NPV), a total hydrocarbon production at a specified time, and a hydrocarbon recovery amount.

19. The method of claim 17, wherein determining an optimal value for the pump rate, the proppant maximum concentration, and the total proppant mass comprises defining a set of specific values for each of the reservoir layer permeability and the reservoir layer in-situ stress, and determining the optimal value for the pump rate, the proppant maximum concentration, and the total proppant mass as the values that provide a best value from the objective function.

20. The method of claim 19, wherein the best value from the objective function comprises a member selected from the group consisting of a greatest mean value, a lowest standard deviation value, and a highest risk-adjusted value.

21. The method of claim 19, wherein the best value from the objective function comprises a member selected from the group consisting of a highest risk-adjusted value according to the equation $F=\mu-\lambda\sigma$, wherein F is the objective function result, $\mu$ is the mean objective function output, $\sigma$ is the standard deviation of the objective function output, and $\lambda$ is a risk aversion factor indicating the limit of acceptable risk.

22. An apparatus, comprising:

a nominal pump schedule module configured to interpret a nominal pump schedule corresponding to a nominal value for each of at least one fracture control parameter;

an environment description module configured to interpret a plurality of environment parameters including at least one uncertain parameter, the environment description module further configured to interpret at least one uncertainty description, each uncertainty description corresponding to one of the uncertain environment parameters;

an objective selection module configured to define an objective function; and a fracture optimization module configured to determine an optimal value for each at least one fracture control parameter according to: the objective function, the plurality of environment parameters, and the at least one uncertainty description.

23. The apparatus of claim 22, further comprising a fracture constraint module configured to interpret a fracture limit criterion, wherein the fracture optimization module is further configured to constrain the optimal value such that a simulated fracture is in accordance with the fracture limit criterion.

24. The apparatus of claim 23, wherein each uncertainty description comprises a statistical description of possible values for the corresponding uncertain environment parameter, and wherein at least one of the uncertainty descriptions comprises a member selected from the group consisting of: a plurality of discrete values, a mean value and a standard deviation, a triangular probability distribution, and a probability distribution function.

25. The apparatus of claim 23, wherein each uncertainty description comprises a statistical description of possible values for the corresponding uncertain environment parameter, and wherein the fracture optimization module is further configured to determine the optimal value for each at least one fracture control parameter by:

defining a set of specific values for each uncertain environment parameter, wherein the set of specific values for each uncertain environment parameter are defined according to the statistical description of possible values for the corresponding uncertain environment parameter, wherein the set of specific values for each uncertain environment parameter comprise a multiplicity of random specific values, each random specific value determined according to the uncertainty description; and determining the optimal value for each at least one fracture control parameter as the value that provides a best value from the objective function.

26. The apparatus of claim 25, wherein the at least one uncertain environment parameter comprises at least one member selected from the group consisting of: an in-situ stress value for a reservoir layer, a permeability value for a reservoir layer, a reservoir layer thickness value, a reservoir layer porosity value, a reservoir layer temperature value, a Young's modulus value for a reservoir layer, a fracture toughness value for a reservoir layer, and a slip allowance at the interface between two reservoir layers.

27. A computer program product on a computer readable medium that, when performed on a controller in a computerized device provides a method for performing the operations of: interpreting a nominal pump schedule corresponding to a nominal value for each of at least one fracture control parameter, interpreting a plurality of environment parameters including at least one uncertain environment parameter, interpreting at least one uncertainty description, each uncertainty description corresponding to one of the uncertain environment parameters, defining an objective function, determining an optimal value for each at least one fracture control parameter according to: the objective function, the plurality of environment parameters, and the at least one uncertainty description.

28. The computer program product of claim 27 that, when performed on a controller in a computerized device further provides a method for performing the operations of calculating a modified pump schedule based on the nominal pump schedule and the optimal value for each at least one fracture control parameter.

29. The computer program product of claim 28 that, when performed on a controller in a computerized device further provides a method for performing the operations of generating a report including: the nominal pump schedule, the modified pump schedule, and a result of the objective function.

30. The computer program product of claim 27 that, when performed on a controller in a computerized device further provides a method for performing the operations of interpreting a fracture limit criterion, wherein determining the optimal value for the fracture control parameter further comprises constraining the optimal value such that a simulated fracture is in accordance with the fracture limit criterion.

31. The computer program product of claim 30 that, when performed on a controller in a computerized device further provides a method for performing the operations of calculating a modified pump schedule based on the nominal pump schedule and the optimal value for each at least one fracture control parameter, determining a limit indicator value indicating whether the optimal value for the fracture control parameter is constrained by the fracture limit criterion, and generating a report including: the nominal pump schedule, the modified pump schedule, a result of the objective function, and the limit indicator value.

32. A system, comprising:

a controller, comprising:

a nominal pump schedule module configured to interpret a nominal pump schedule corresponding to a nominal value for each of at least one fracture control parameter;

an environment description module configured to interpret a plurality of environment parameters including at least one uncertain parameter, the environment description module further configured to interpret at least one uncertainty description, each uncertainty description corresponding to one of the uncertain environment parameters;

an objective selection module configured to define an objective function; and a fracture optimization module configured to determine an optimal value for each at least one fracture control parameter according to: the objective function, the plurality of environment parameters, and the at least one uncertainty description;

a fracture planning module configured to calculate a modified pump schedule based on the nominal pump schedule and the optimal value for each at least one fracture control parameter;

fluid mixing means that prepares a fracturing fluid according to the modified pump schedule; and pumping means that pumps the prepared fracturing fluid into a well according to the modified pump schedule.

33. The system of claim 32, wherein the fracturing fluid comprises one of a hydraulic fracturing fluid and an acid fracturing fluid.

34. The system of claim 32, wherein the objective function comprises a member selected from the group consisting of: a net present value (NPV), a total hydrocarbon production at a specified time, and a hydrocarbon recovery amount.

35. The system of claim 32, comprising a display means that shows a first simulated fracture according to the nominal pumping schedule and a second simulated fracture according to the modified pump schedule.

* * * * *